United States Patent [19]

Martin

[11] 4,291,559

[45] Sep. 29, 1981

[54] SHEAVE MAKING APPARATUS AND METHOD

[76] Inventor: Charles F. Martin, P.O. Box 197, Porter, Tex. 77365

[21] Appl. No.: 61,923

[22] Filed: Jul. 30, 1979

[51] Int. Cl.[3] ..... B21H 1/04

[52] U.S. Cl. ..... 72/84; 72/86; 72/110; 29/159 R

[58] Field of Search ..... 72/84, 86, 87, 102, 72/107, 110, 70, 71; 29/159 R, 159.1

[56] References Cited

U.S. PATENT DOCUMENTS

| | | | |
|---|---|---|---|
| 659,723 | 10/1900 | Williams | 72/102 |
| 1,430,989 | 10/1922 | Heisler | 72/86 |
| 2,338,161 | 1/1944 | Ashton | 29/159 |
| 3,225,425 | 12/1965 | Skinner et al. | 72/71 |

*Primary Examiner*—Lowell A. Larson
*Attorney, Agent, or Firm*—Browning, Bushman & Zamecki

[57] ABSTRACT

Disclosed are an apparatus and method for making a sheave by forming an external annular radial groove in the periphery of a circular workpiece. The apparatus includes a support for supporting the workpiece for rotation about its own axis. At least one groove-forming tool having a working surface for extending radially into the periphery of the workpiece is carried by a tool guide adjacent the support for movement past the workpiece in a path such that the outer extremity of the working surface passes generally tangentially to the locus of the bottom of the groove to be formed. A tool drive assembly is provided for moving the tool in such path. A pair of drive rollers are mounted on the support for rotation about respective axes disposed angularly with respect to the axis of the workpiece and having respective opposed drive surfaces for engagement with opposite sides of the workpiece distal its axis. Drive mechanisms are provided for rotating the rollers about their respective axes and also moving them generally radially outwardly with respect to the workpiece toward the working surface of the tool.

34 Claims, 10 Drawing Figures

FIG. 9
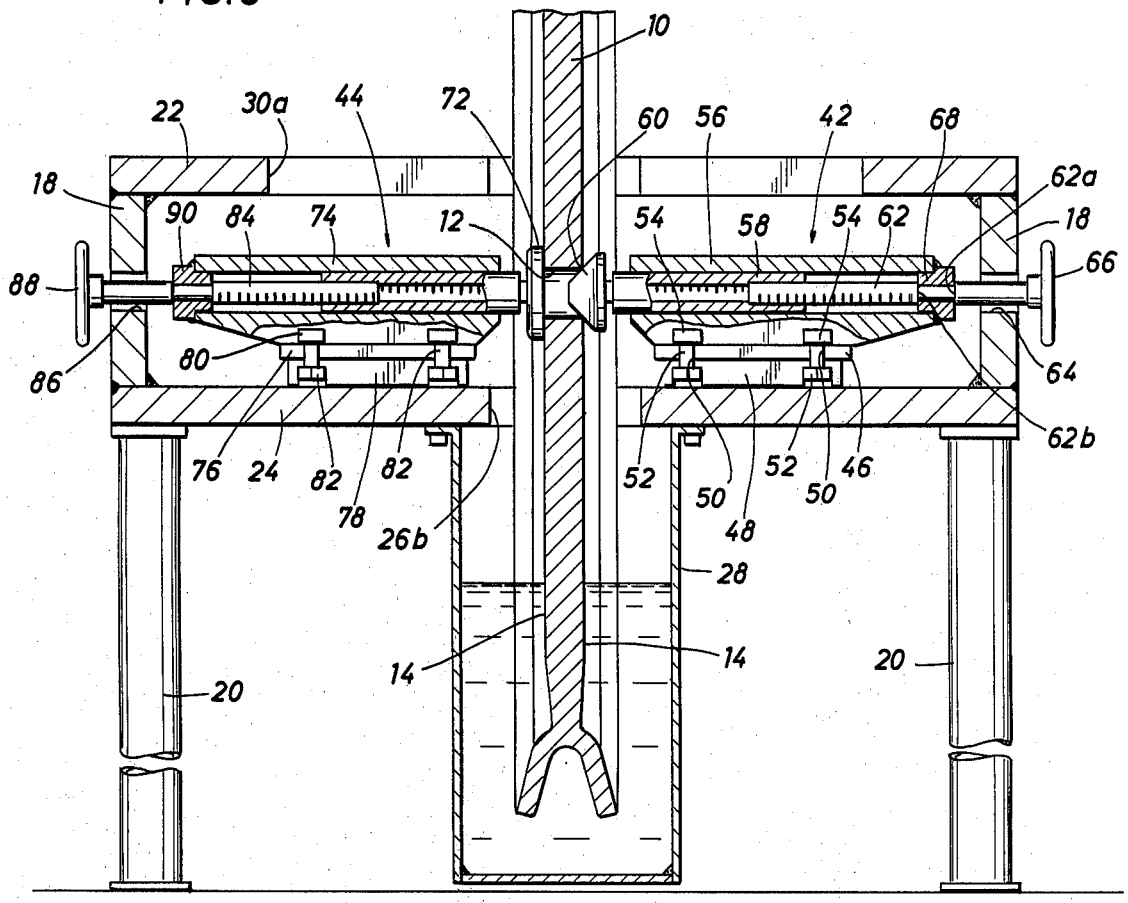
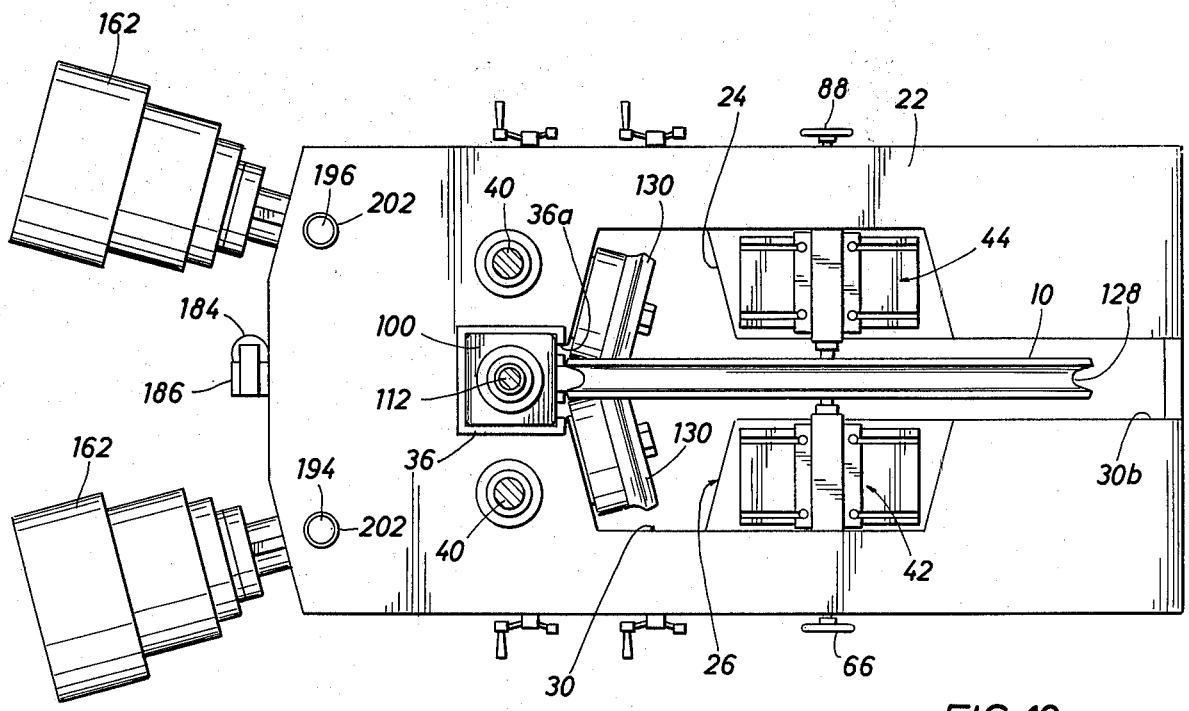
FIG. 10

SHEAVE MAKING APPARATUS AND METHOD

BACKGROUND OF THE INVENTION

1. Field of the Invention

The present invention pertains to the forming of external annular radial grooves in the peripheries of circular workpieces. More specifically, the invention comprises a method and apparatus for making a monolithic sheave by forming such a groove in the periphery of a circular plate. In general, presently known techniques for making sheaves are unduly expensive and/or inefficient, and in many cases, still result in a finished article of less than optimum structural strength. These problems are encountered in forming an appropriately shaped groove about the periphery of the sheave defined by rims or lips diverging radially outwardly with respect to the central disk-like portion of the sheave.

2. Description of the Prior Art

Theoretically, a monolithic sheave having the aforementioned diverging rims and groove could be formed by casting and machining a suitable metal. However, as can be readily appreciated, such a procedure is extremely expensive, particularly where the sheave to be formed is a relatively large one. Machining alone is likewise expensive as well as wasteful of the metal which is cut away during the process.

Accordingly, it has become conventional to cast and/or machine the peripheral portion of the sheave, i.e. the aforementioned diverging rims defining a groove therebetween, separately from the central portion and later secure the two pieces together by welding or the like. While this may somewhat lessen the expense over the techniques described above by reducing the amount of metal which must be cast and/or machined, it requires precise sizing of the inner diameter of the peripheral portion and outer diameter of the central portion, and in any event, may result in a finished article which is structurally weak at the junction between these two portions.

Some prior efforts have been made toward developing apparatus for forming a monolithic sheave, so as to eliminate the aforementioned juncture, by metal forming techniques, as opposed to casting and/or machining. See, for example, German Pat. No. 2,107,049. However, these techniques have generally involved equally undesirable features. For example, some such techniques require heating of the metal during the forming process while others do not provide for adequate structural strength in the peripheral portion of the sheave. Furthermore, such devices are, in general, still unduly expensive, particularly in view of the quality of the articles which they produce.

SUMMARY OF THE INVENTION

The present invention provides an apparatus and method for making a monolithic sheave from a workpiece in the form of a circular plate using metal forming action, as opposed to casting and/or machining. At the same time, the apparatus and method of the invention are less complicated and expensive than prior devices and techniques developed for similar purposes. For example, the present invention does not require heating of the peripheral area of the workpiece while it is being formed. Furthermore, the invention results in a more precisely and perfectly configured peripheral formation, and not only does not structurally weaken any portion of the peripheral formation, but on the contrary, work hardens the peripheral area while forming same.

More specifically, the apparatus, for forming an external annular radial groove in the periphery of a circular workpiece comprises support means for supporting the workpiece for rotation about its own axis, at least one groove-forming tool having a working surface for extending radially into the periphery of the workpiece, and tool guide means adjacent the support means. The tool guide means carries the tool for movement past the workpiece in a path such that the outer extremity of the working surface of the tool passes generally tangentially to the locus of the bottom of the groove to be formed in the workpiece. Tool drive means are provided in association with the tool guide means for moving the tool in the aforementioned path. Rotary drive means are also included for rotating the workpiece about its own axis, and preferably include a pair of drive rollers mounted on the support means for rotation about respective axes disposed angularly with respect to the axis of the workpiece. Such rollers have respective opposed generally radially outwardly facing drive surfaces disposed for engagement with opposite sides of the workpiece distal its axis. Means are provided for rotating the rollers about their respective axes to thereby rotate the workpiece about its axis. Additionally, radial drive means are provided for moving the rollers generally radially outwardly with respect to the workpiece and toward the working surface of the tool, in its terminal or deepest forming position with respect to the workpiece, whereby the drive surfaces of the rollers further serve as forming surfaces for forming external areas of the workpiece adjacent the groove formed by the tool.

In preferred embodiment, means are associated with the drive rollers for urging their drive surfaces progressively closer to each other against the workpiece as the rollers are moved radially along the workpiece toward the working surface of the tool. Accordingly, these rollers, in cooperation with the tool's working surface, may be designed to slightly reduce the axial thickness of the workpiece and increase its outer diameter adjacent its periphery by deforming the material of the workpiece during the aforementioned movements. Simultaneously, the material in the general peripheral area of the workpiece is thus work hardened. The drive rollers and/or adjacent respective floating rollers, together with the tool and its forming surface, are configured so that the finished form of the peripheral area of the workpiece includes a pair of diverging annular lips having the aforementioned groove defined therebetween and an area of gradually reduced thickness located just inwardly of said lips.

Likewise, in preferred embodiments, a plurality of tools are carried by the tool guide means for successive movement past the workpiece in the aforementioned path. These tools have successively wider working surfaces for progressively laterally enlarging the groove. The movement of the drive rollers radially along the workpiece is preferably controlled so that such rollers do not reach the periphery of the workpiece and begin final formation of the outer surfaces of the aforementioned diverging lips until the last of the tools, i.e. the one having the widest working surface and that which corresponds to the desired finished inner configuration of the groove, has reached its terminal forming position with respect to the workpiece, i.e. that position in which its working surface is at its deepest extension into the periphery of the workpiece.

Accordingly, it is a principal object of the present invention to provide an improved apparatus and method for forming an external annular radial groove in the periphery of a circular workpiece.

Another object of the present invention is to provide such an apparatus and method in which at least one groove-forming tool is moved past the workpiece in a path such that the outer extremity of a working surface of the tool passes generally tangentially to the locus of the bottom of the groove to be formed.

Still another object of the present invention is to provide such an apparatus and method in which drive rollers for rotating the workpiece about is own axis are also moved radially outwardly along the workpiece, while being urged thereagainst, to form the external surfaces of the peripheral area of the workpiece.

Still other objects, features, and advantages of the present invention will be made apparent by the following detailed description of a preferred embodiment, the drawings, and the claims.

BRIEF DESCRIPTION OF THE DRAWINGS

FIG. 9 is a sectional view taken along the line 9—9 of FIG. 6.

FIG. 10 is a partial top plan view of the apparatus.

DESCRIPTION OF THE PREFERRED EMBODIMENT

Figures 1, 2:
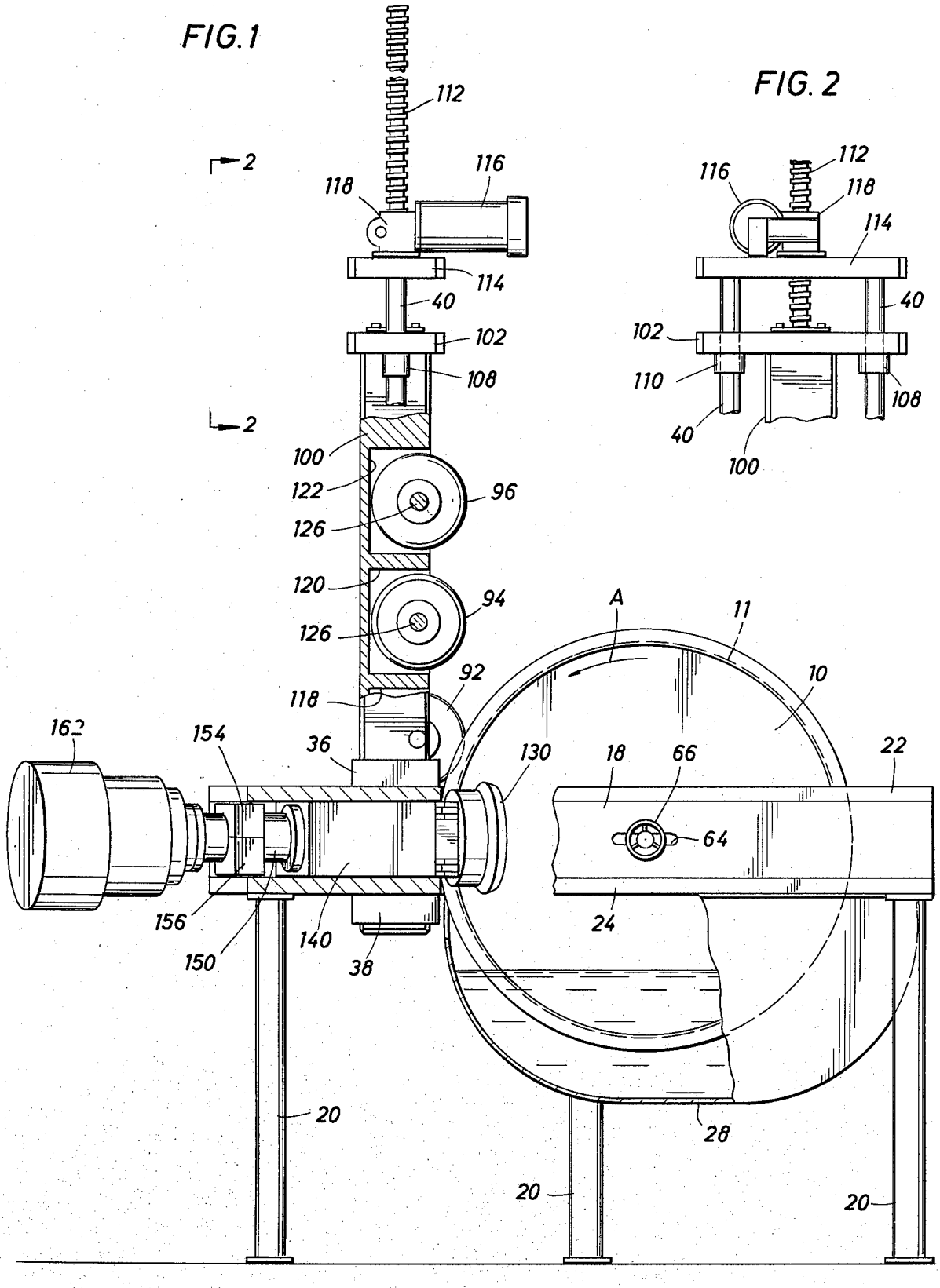
FIG. 1 is a view in side elevation, with parts broken away, of the apparatus of the invention.
FIG. 2 is a detailed front elevational view taken on the line 2—2 of FIG. 1.

Referring to the drawings, there is shown a preferred embodiment of the apparatus for making a sheave by forming an external annular radial groove in the periphery of a circular workpiece 10. As shown in phantom in FIG. 3, prior to working by the apparatus and method of the invention, workpiece 10 is a circular plate of metal having a central longitudinal bore 12, planar circular opposite side surfaces 14, and a cylindrical peripheral surface 16. The apparatus and method of the invention serve to form an external annular radial groove in peripheral surface 16, and more specifically, serve to form a pair of lips diverging radially outwardly adjacent the periphery of workpiece 10 and defining such groove therebetween.

Figure 8:
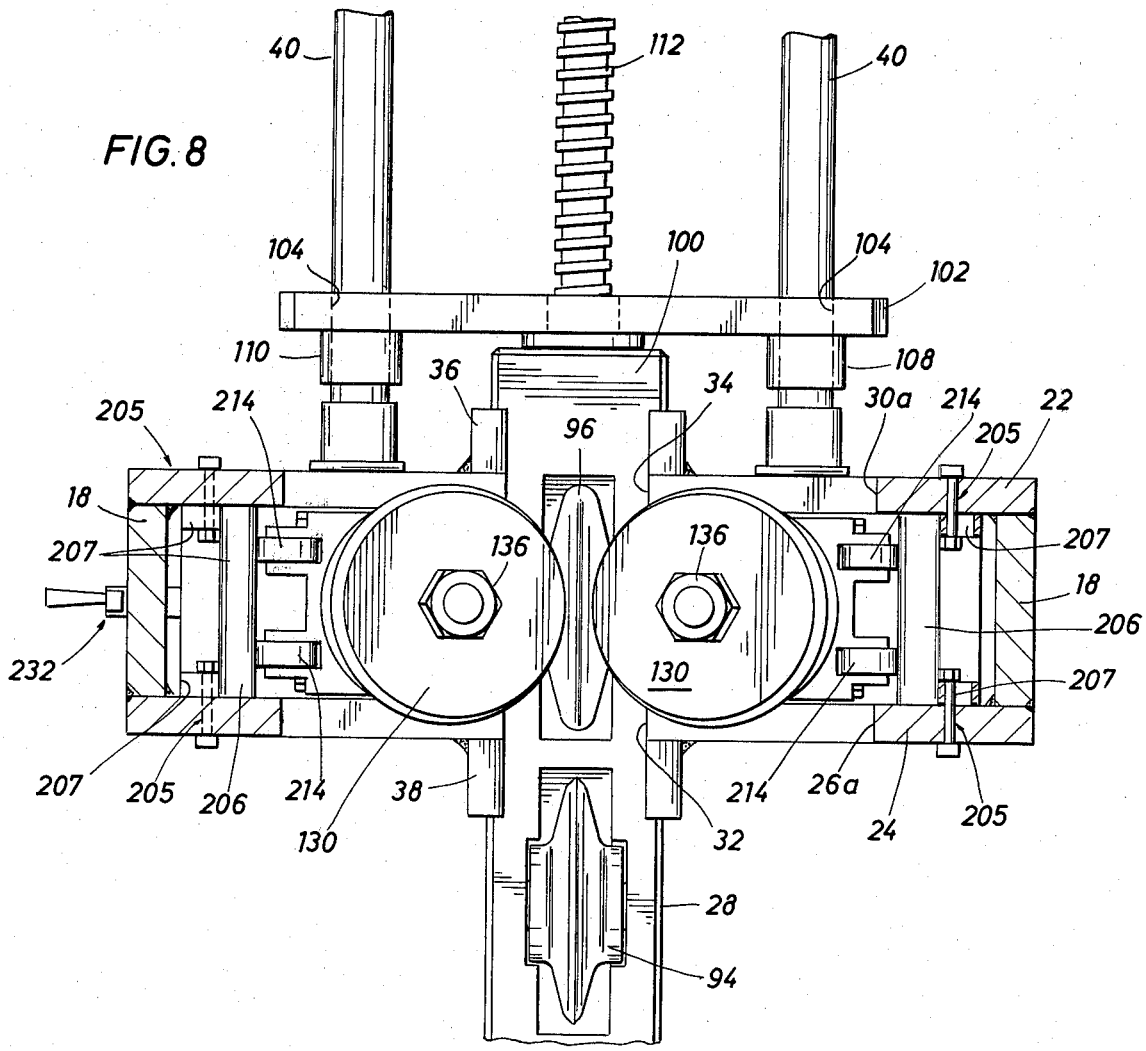
FIG. 8 is a sectional view taken on the line 8—8 of FIG. 6.

The apparatus includes a supporting framework for supporting the workpiece 10 and also for supporting and/or locating the various working parts to be described below relative to the workpiece. The framework includes a pair of parallel side plates 18 supported by vertical legs 20. Rigidly affixed to and interconnecting the upper ends of side plates 18 in a top plate 22. Similarly, a bottom plate 24 is rigidly affixed to and interconnects the lower ends of side plates 18. Lower plate 24 has a vertical opening 26 therethrough including a relatively wide forward portion **26*a* and a relatively narrow rear portion 26*b*. The framework further includes a sump 28 bolted or otherwise affixed to the underside of bottom plate 24 with the open upper end of the sump in communication with opening 26. Sump 28 contains a suitable lubricant for bathing the workpiece during operation. Like bottom plate 24, top plate 22 has a vertical opening 30 therethrough. Like the opening 26 of bottom plate 24, opening 30 has a relatively wide forward portion 30*a* and a relatively narrow rear portion 30*b*. However, as best seen in FIG. 10, forward portion 38 extends farther rearwardly than portion 26*a* of bottom plate opening 26. Openings 26 and 30 allow for prosecution of workpiece 10, as well as other parts of the apparatus to be described below, through plates 22 and 24, e.g. as shown in FIGS. 8 and 9. A narrow front plate 178 is affixed to and extended between the forward end of top and bottom plates 22 and 24**.

Just forward of and continuous with openings 26 and 30 respectively, plates 24 and 22 have respective square openings 32 and 34 therethrough (see FIG. 8). A square guide sleeve 36, having inner dimensions substantially equal to those of opening 34, is welded or otherwise rigidly affixed to the upper side of plate 22 in register with opening 34. A similar square guide sleeve 38 is affixed to the underside of lower plate 24 in register with opening 32. The supporting framework also includes a pair of parallel vertical guide rods 40 affixed to and extending upwardly from upper plate 22 on opposite sides of guide sleeve 36.

Headstock and tailstock assemblies, generally indicated at 42 and 44 respectively, are mounted on bottom plate 24 on opposite sides of opening 26 for supporting the workpiece 10 for rotation about its own axis. Assembly 42 includes a block 46 which rests upon a stationary base plate 48 having a pair of parallel slots 50 therein extending generally length-wise of the overall apparatus. Four bolts 52, having their heads disposed in enlarged sections of slots 50, extend upwardly through respective bores in block 46, two of the bolts riding in one of the slots 50 in plate 48, and the other two of the bolts 52 riding in the other of the slots 50. The shanks of bolts 52 extend upwardly from blocks 46 and receive nuts 54 whereby block 46 is secured to base plate 48, but permitted to be slidably adjusted therealong generally length-wise of the apparatus.

A stationary bearing member 56 is rigidly affixed to block 46 in any suitable manner. Bearing member 56 has a central bore extending transversely of the apparatus in general and slidably and rotatably receiving a rotary bearing member 58. The end of member 58 closest to the center of the apparatus extends outwardly from member 56 and carries a tapered pin 60. The other end of member 58 is open for receipt of one end of a shaft 62 threaded into rotary bearing member 58. The other end of shaft 62 extends outwardly from the end of stationary bearing member 56 distal the center of the apparatur and through a slot 64 in the adjacent side plate 18. A handle 66 is mounted on the outer end of shaft 62 externally of plate 18.

Figure 3:
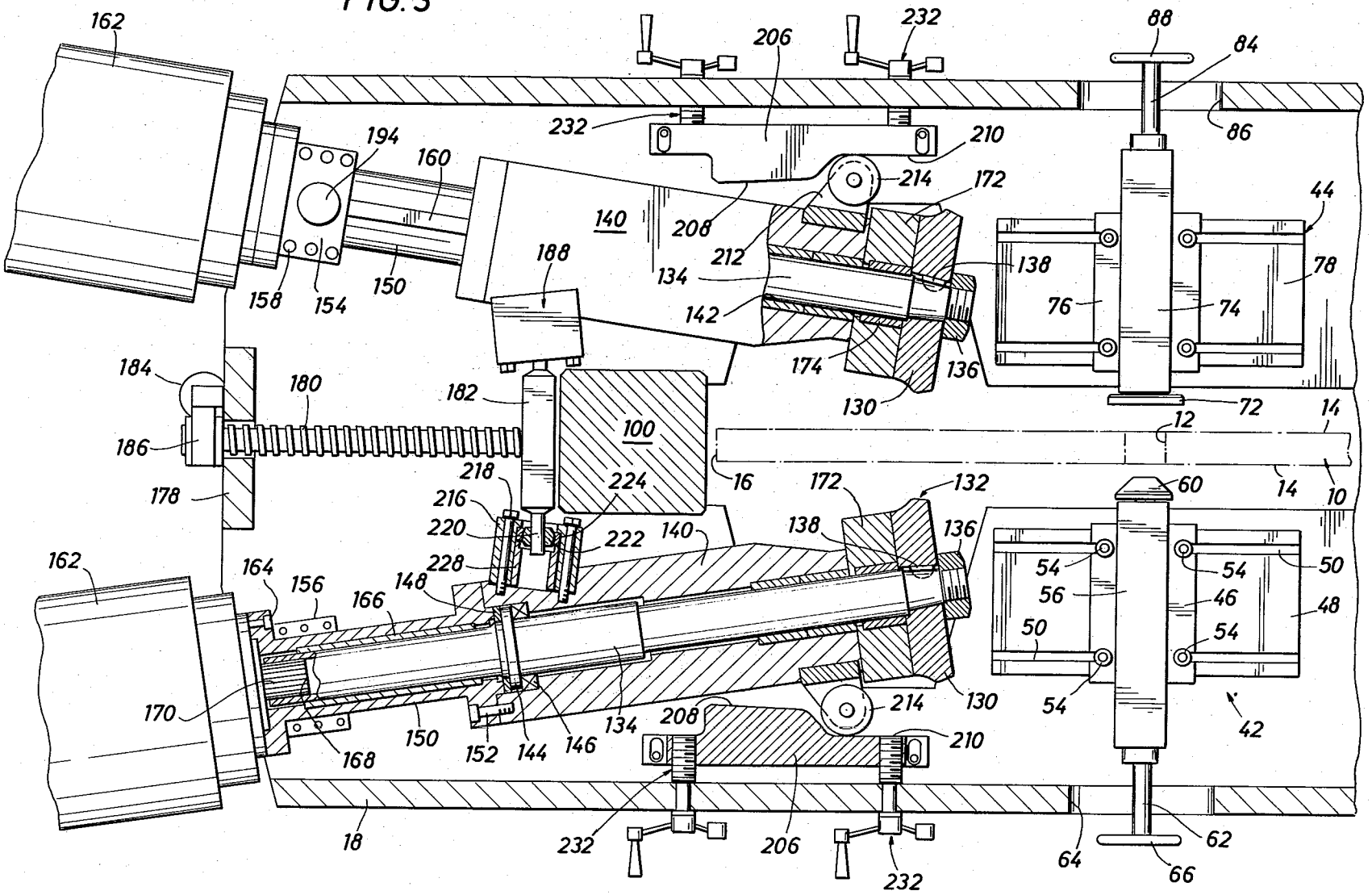
FIG. 3 is a transverse partial-elevational and partial-sectional view taken along the line 3—3 in FIG. 1 and showing the apparatus in an initial position for receipt of a workpiece.
Figure 6:
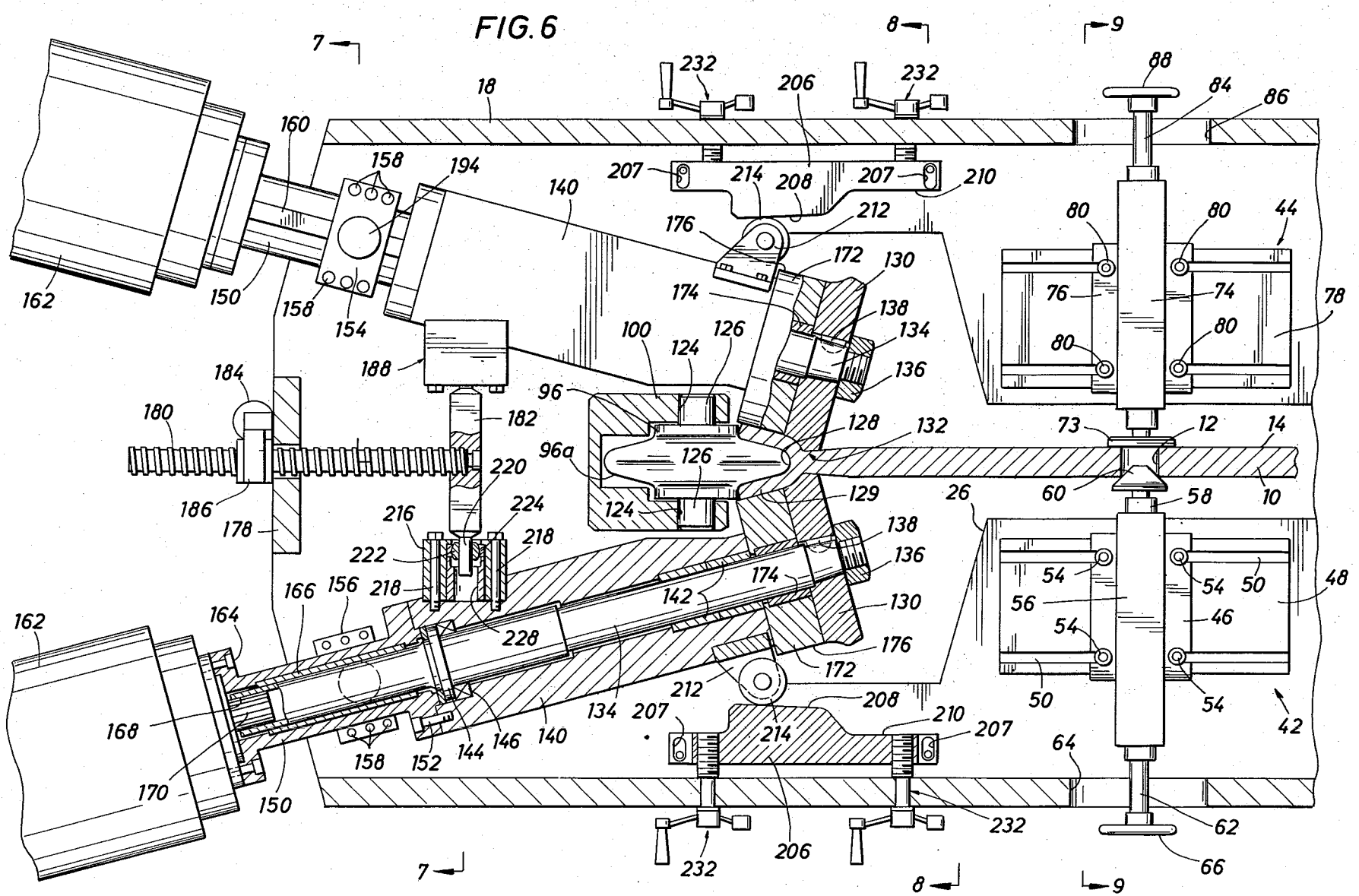
FIG. 6 is a view similar to that of FIG. 3 showing the apparatus in a final stage with the last tool as well as the drive rollers in their terminal forming positions.

An annular stop member 68 is fixed on the end of stationary bearing member 56 adjacent side plate 18 and receives a reduced diameter section of shaft 62. Such reduced diameter section defines shoulders 62*a* and 62*b* which abut opposite ends of member 68 to prevent movement of the attached shaft 62 longitudinally of itself. Accordingly, since shaft 62 cannot move longitudinally within stationary bearing member 56, rotation of shaft 62 via handle 66 will cause rotary bearing member 58 to advance or retract toward or away from workpiece 10 by virtue of the threaded interengagement of member 58 and shaft 62. Accordingly, pin 60 may be retracted, as shown in FIG. 3, to permit implacement or removal of workpiece 10, or advanced, as shown in FIGS. 6 and 9 so that it extends into the central bore 12 of the workpiece.

Assembly 44 is substantially identical to assembly 42, and more specifically, is a mirror image of assembly 42 except for the fact that its rotary bearing member 70 does not carry a pin such as 60, but rather a bracing member 72 having a flat end face for abutment with the side 14 of workpiece 10 opposite pin 60. Briefly, assembly 44, in addition to rotary bearing member 70 and the attached member 72, includes a stationary bearing member 74 slidably and rotatably receiving member 70 and rigidly affixed to a block 76. Block 76 is in turn slidably mounted on a slotted base plate 78 via nuts 80 and bolts 82. A shaft 84 has one end threaded into rotary bearing member 70 and the other end extending outwardly through a slot 86 in the adjacent side plate 18 of the framework and carrying a handle 88. Shaft 84 also passes through a stop member 90 similar to member 68 of assembly 42. Accordingly, bracing member 72 can be advanced toward and retracted from the locus of guide piece 10 by rotation of handle 88.

When both rotary bearing members 58 and 70 are advanced by equal amounts, the flat end face of bracing member 72 will come into abutment with one side 14 of workpiece 10, while pin 60 will enter the bore 12. Thus, workpiece 10 will be clamped between members 72 and 60 and supported on member 60 for rotation along with bearing members 70 and 58 about its own aixs. The flattened face of bracing member 72 also serves to keep workpiece 10 plumb, while pin 60 is positioned to properly align the axis of workpiece 10 with the terminal forming position of a tool to be described below. The ability of assemblies 42 and 44 to permit advancing and retracting of members 60 and 72 also permits the apparatus to accommodate workpieces of varying thicknesses.

Furthermore, the slidable mounting of the bearings of respective assemblies 42 and 44 on plates 48 and 78 also permits the apparatus to be adjusted to accommodate workpieces of different diameters. More specifically, by slightly loosening nuts 54 and 80, the blocks 46 and 76 can be adjusted length-wise of respective plates 48 and 78 to the appropriate positions, whereupon nuts 54 and 80 may be retightened to retain the blocks in those positions. As shown in FIGS. 1, 3 and 6, the slots 64 and 86 in side plates 18 throuigh which respective shafts 62 and 84 extend, are elongated generally lengthwise of the apparatus as a whole to allow for such adjustment. The tapered or frustoconical configuration of pin 60 permits it to engage and support workpieces having central bores 12 of different diameters.

The apparatus includes a series of tools in the form of discs 92, 94, and 96. These discs have respective radially outer working surfaces 92*a*, 94*a*, and 96*a* for extending into the periphery of workpiece 10 for forming a groove therein. While each of the working surfaces 92*a*, 94*a* and 96*a* have opposite side portions diverging radially inwardly, such surfaces are successively laterally wider as well as blunter than one another so that, by successive contact of the three tools with the workpiece 10, the groove may be progressively laterally enlarged. (At this point, it is noted that, as used herein, terms such as "radially," "longitudinally," "laterally," etc. should be construed with reference to the members which they describe unless otherwise noted.)

Tools 92, 94, and 96 are mounted on a carrier 100 for rotation about their own axes, said axes being parallel to that of workpiece 10. Carrier 100 is vertically elongated member of square transverse cross-sectional configuration sized for a sliding fit in bores 32 and 34 and guide sleeves 36 and 38 of the supporting framework of the apparatus. Accordingly, the last-mentioned openings and guide sleeves serve as the primary stationary guide means for guiding carrier 100 in a straight line vertical path with respect to the framework. A plate 102 is rigidly affixed to the upper end of carrier 100 and extends laterally outwardly therefrom. Plate 102 is rigidly affixed to the upper end of carrier 100 and extends laterally outwardly therefrom. Plate 102 has a pair of vertical bores 104 and 106 therethrough, each registering with a respective one of two guide sleeves 108 and 110 rigidly affixed to the underside of plate 102. Bore 104 and the aligned sleeve 108 slidably receive one of the rods 40 of the apparatus framework, while bore 106 and sleeve 110 similarly receive the other rod 40. Accordingly, these bores, sleeves, and rods provide additional guidance and stabilization for carrier 100 with respect to the apparatus framework.

Tool drive means are provided for moving carrier 100 in a straight line vertical path. The tool drive means include a threaded shaft 112 rigidly affixed to and extending upwardly from plate 102. A stationary plate 114 is mounted across the upper ends of rods 40, and shaft 12 extends through plate 114. On the upper side of plate 114 is mounted a motor 116 which drives a gear assembly 118 which in turn engages shaft 112 to reciprocate the shaft and attached carrier 100 along the aforementioned vertical path. Motor 116 is preferably a variable speed motor whereby the operator of the apparatus can control the rate of movement of carrier 100.

Carrier 100 has three vertically spaced recesses 118, 120, and 122 each opening outwardly through that side of carrier 100 generally facing workpiece 10. Each of the tools 92, 94 and 96 is rotatably mounted in a respective one of the recesses 118, 120, and 122, the working surfaces 92*a*, 94*a* and 96*a* protrude outwardly through the open sides of such recesses whereby they may contact workpiece 10. Primary guide sleeves 36 and 38 also have slots opening toward workpiece 10, to allow for passage of discs 92, 94, and 96 through the guide sleeves during operation. The side walls of carrier 100 defining recesses 118, 120 and 122 have lateral bores 124 therethrough for receiving and rotatably mounting the trunions 126 of the respective tools 92, 94, or 96.

It can be seen that, as carrier 100 is moved in a straight line vertical path by tool drive means 112, 116, 118, tools 92, 94, and 96 will be moved in a like path. Furthermore, assemblies 42 and 44 position workpiece 10 so that its axis is disposed at 90° to such vertical path. By proper positioning of assemblies 42 and 44 along slotted guide plates 48 and 78 in the manner described above, workpiece 10 may be adjusted with respect to the path of tools 92, 94, 96 so that, when the tools are moved in such path, the outer extremeties or apexes of their working surfaces 92*a*, 94*a* and 96*a* pass generally tangentially to a circle 11 representing the locus of the bottom of the groove to be formed in workpiece 10. In operation, carrier 100 with the attached tools is moved downwardly while workpiece 10 is rotated about its own axis, by means to be described more fully below, so that the periphery of the workpiece moves in a circular path having a section overlapping a section of the path of the tools. Workpiece 10 is rotated in the direction indicated by arrow A in FIG. 1 so that, along such overlapping sections of the paths, the tools 92, 94, 96 and the periphery of workpiece 10 will be moving in generally the same direction, i.e. downwardly. However, the rate of movement of the periphery of workpiece 10 is preferably much greater than the rate of downward movement of carrier 100.

Figure 4:
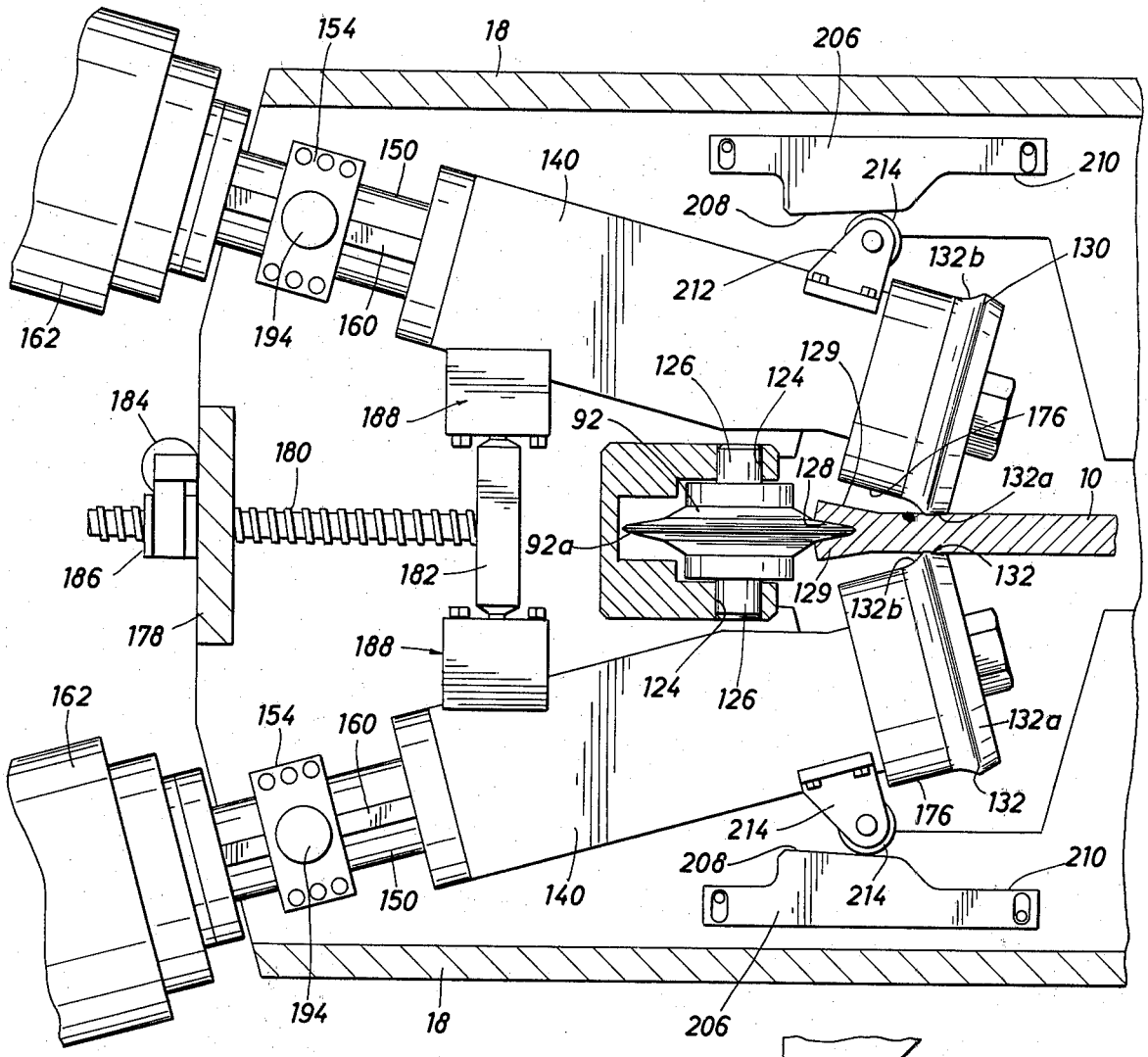
FIG. 4 is a partial view similar to that of FIG. 3 showing the apparatus during an early stage of the forming process, the first of a series of tools being engaged with the workpiece.

At the beginning of an operational sequence, carrier 100 will be disposed in an uppermost position wherein the lowermost tool 92 is spaced from workpiece 10. As carrier 100 begins to move downwardly as described above, the outer periphery of the working surface 92*a* of tool 92 will contact the periphery of workpiece 10 at the beginning of the overlapping sections of their respective paths. Such contact will cause tool 92 to rotate about its own axis on trunions 126. As the downward movement of carrier 100 continues, the working surface 92*a* extends deeper and deeper into the periphery of workpiece 10 until it reaches a terminal forming position at which its outer extremity is tangent to the locus 11 of the ultimate desired groove depth. This terminal forming position will be that in which the axis of tool 92 and workpiece 10 are horizontally aligned and perpendicular to carrier 100. Another way of describing the terminal forming position of the tool is that, in such position, a radius of the workpiece is continuous with and colinear with a radius of said tool. FIG. 4 shows the tool 92 as related to the workpiece 10 in its terminal forming position.

Figure 5:
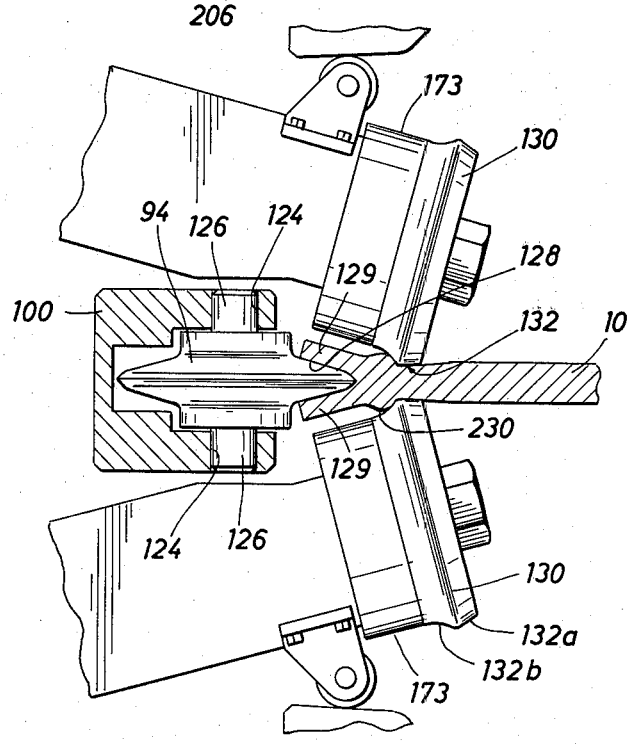
FIG. 5 is a partial view similar to that of FIG. 4 showing the apparatus at a further stage with a second tool in engagement with the workpiece.

As previously mentioned, in the terminal forming position, the working surface 92*a* will be at its deepest position with respect to the periphery of workpiece 10, i.e. its outer extremity will be tangent to the locus of the bottom of the groove which it is to form in that workpiece. Accordingly, upon further movement of tool 92 downwardly from its terminal forming position, it will perform no further forming function even though its path will continue to overlap that of the periphery of workpiece 10 for a time. However, by that time, the next adjacent tool 94 will have moved into the overlapping sections of the tool and workpiece periphery paths, and because its working surface 94*a* is laterally wider than the working surface 92*a* of the preceeding tool, it will further widen the groove 128 being formed in workpiece 10 as shown in FIG. 5. Tool 94 will, while thus widening groove 128, move deeper and deeper into the periphery of workpiece 10 until it reaches a terminal forming position, being the same position with respect to the overall apparatus as previously described with respect to tool 92. By the time tool 94 begins to move downwardly from such terminal forming position so that its working surface 94*a* is no longer contacting workpiece 10, the last tool 96 will have moved into the overlapping sections of the tool and workpiece periphery paths and, as it moves downwardly, will even further widen groove 128. Working surface 96*a* has a configuration precisely matching the desired internal configuration of groove 28 in its finished form. Accordingly, by the time tool 96 reaches a forming position, which is the same position relative to the apparatus as the terminal forming positions of the preceeding tools 92 and 94, groove 128 will have the desired configuration.

Tools 92, 94, and 96 progressively form groove 128 by a metal forming action, as opposed to a cutting action. Thus, there is virtually no removal of metal from workpiece 10, and accordingly, neither waste of the metal nor any need for subsequent polishing or other finishing procedures. The means for rotating workpiece 10, to be described hereafter, also serves to properly form the exterior surfaces of the peripheral area of workpiece 10 near groove 128, as well as to work harden such peripheral area, resulting in a finished article having a high degree of structural strength as well as an extremely accurately controlled configuration.

Specifically, workpiece 10 is rotated by a pair of drive rollers 130 located on opposite sides of workpiece 10 and having opposed generally radially outwardly facing drive surfaces 132 disposed for engagement with respective opposite sides 14 of workpieces 10 distal the axis of the workpiece. Each roller 130 is mounted on a respective shaft 134 for rotation therewith. As previously mentioned, each of the tools 92, 94, and 96 has a terminal forming position in which a radius thereof is continuous with and colinear with a radius of the workpiece. The axes of rollers 130 and their shafts 134 are dispoesd in a common plane with the locus of such colinear radii so that rollers 130 will be generally horizontally aligned with each of the tools 92, 94, and 96 as it reaches its terminal forming position. Additionally, the axes of rollers 130 and shafts 134 are angularly disposed with respect to the axis of workpiece 10 so that when rollers 130 are rotated about their axis, while urged toward each other against the sides 14 of workpiece 10, they will cause rotation of the workpiece.

Each roller 130 is retained on its respective shaft 134 by a nut 136 threaded to the shaft and is caused to rotate therewith by a respective key 138. Shafts 134 are in turn rotatably mounted in respective casings 140 on bushings 142. Adjacent the end of its casing 140 distal roller 130, each shaft 134 has an annular flange 144 extending outwardly therefrom. On one side of flange 144 shaft 134 is sealed to casing 140 as indicated at 146. On the other or outer side of flange 144 is disposed an annular thrust washer 148 for abutment with the opposed end of a generally tubular housing 150 bolted to the adjacent end of casing 140 as indicated at 152. Each housing 150 is surrounded by a split block assembly; the two halves 154 and 156 of which are secured together by bolts 158.

The end of each housing 150 distal the respective casing 140 is bolted to a rotary drive motor 162 as indicated at 164. Each shaft 134 extends beyond its flange 144 into the respective housing 150 and is rotatably mounted therein by a bushing 166. The end of shaft 134 nearest the respective motor 162 has a splined socket 168 which receives the correspondingly splined end 170 of the drive shaft of such motor. Accordingly, motor 162 may rotate the respective roller 130 via the intermediate shaft 134. Between each roller 130 and its respective casing 140 there is a floating roller 172 disposed in surrounding relation to the shaft 134. An annular bushing 174 is disposed between each of the rollers 172 and its respective shaft 134 to permit the shaft to rotate within the roller. Rollers 172 further have opposed generally radially outwardly facing surfaces 176 which are virtually continuous with the adjacent drive surfaces 132 of respective rollers 130.

In addition to being rotated by motors 162, rollers 130 are moved radially outwardly along workpiece 10 toward the terminal forming positions of the tools while simultaneously being urged closer to each other against workpiece 10. The radial movement or rollers 130 along workpiece 10 is provided by a radial drive means. A drive screw 180 extends horizontally through front plate 178 and has a mounting plate 182 secured to its inner end. On the outer side of front plate 178 there is mounted a motor 184 which drives a suitable gear assembly 186 engaging drive screw 180 to reciprocate same toward and away from workpiece 10. Mounting plate 182 is connected to casings 140 via swivel assemblies 188 to be described more fully below. Thus, as screw 180 is reciprocated, casings 140 will be correspondingly reciprocated along with the attached housings 150, shafts 134, and rollers 130 and 172. To guide and stabilize the latter assemblages in such reciprocating movement, casings 140 are sized for a sliding fit between top and bottom plates 22 and 24 of the stationary framework as best shown in FIG. 1. Additionally, housings 150 are provided with upper and lower keys 160 and 161 extending lengthwise thereof. Keys 160 and 161 extend into respective grooves 190 and 192 in upper and lower members 154 and 156 respectively of the block assemblies surrounding the respective housings 150. These block assemblies are in turn mounted on the stationary framework by pivot pins 194 and 196, the former extending upwardly from member 154 into a bore 198 in top plate 22, and the latter extending from member 156 into a bore 200 in bottom plate 24. Bores 198 and 200 are provided with respective annular bushings 202 and 204 for facilitating pivotal movement of pins 194 and 196 therein. Accordingly, as housings 150 reciprocate along with the attached parts, their keys 160 and 161 slide through block assemblies 154, 156 providing further guidance and stabilization during such movement.

In order to urge rollers 130 toward each other as they are moved radially outwardly along workpiece 10 as described above, a pair of cam bodies 206 are mounted on top and bottom plates 22 and 24 of the framework of the apparatus by nut and bolt assemblies 205. Cam bodies 206 are identical and include opposed cam surfaces 208 inclined toward each from their rear to their forward ends. Adjacent the rear extremity of its cam surface 208, each of the bodies 206 has a cut-away section 210. Each of the casings 140 carries two sets of brackets 212 on each of which a roller 214 is mounted for rolling engagement with surfaces 210 and 208 of the adjacent cam body 206.

At the beginning of a sequence of operation, i.e. when tool carrier 100 is in its uppermost position and lowermost tool 92 has not yet contacted the workpiece, radial drive screw 180 is advanced inwardly toward the workpiece so that rollers 214 are disposed in cut-away areas 210 of cam bodies 206. Screw 180 is then retracted away from the workpiece causing rollers 214 to pass out of cut-away areas 210 and onto the rear extremities of cam surfaces 208. This urges the rear ends of casings 140, along with the respective shafts 134 and rollers 130, laterally inwardly toward each other bringing the drive surfaces 132 of rollers 130 into engagement with opposite sides 14 of workpiece 10. Accordingly, rollers 130 will then begin to rotate the workpiece. While continuing to rotate rollers 130 and retract screw 180 outwardly away from workpiece 10, tool carrier 100 is gradually lowered as described above. As screw 180 is so retracted, rollers 130 will be urged closer and closer together due to the inclination of cam surfaces 208.

Figure 7:
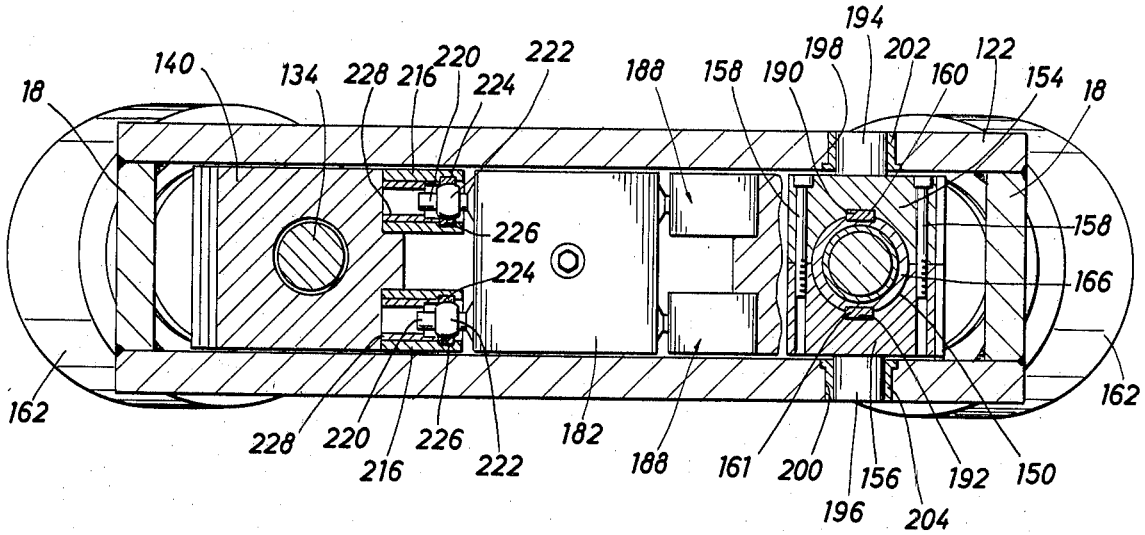
FIG. 7 is a sectional view taken on the lines 7—7 of FIG. 6.

Such movement of rollers 130 toward each other is permitted by the aforementioned pivotal mounting of blocks 154, 156 in the apparatus framework via pins 194, 196 in conjunction with swivel assemblies 188. As best seen by comparing FIGS. 3, 6 and 7, swivel assemblies 188 are four in number, each of the casings 140 having a pair of such assemblies secured thereto one above the other. Each assembly 188 includes an outer housing 216 rigidly affixed to the respective one of casings 140 by screws 218. Mounting plate 182 has four integral pins 220 each extending laterally outwardly (with respect to the apparatus as a whole) into a respective one of the swivel housings 216. A ball 222 is mounted on each pin 220. Ball 222 has its outer surface engaged by an arcuate race 224 which in turn is fixed in an internal annular groove 226 in swivel housing 216. A counter-bored sleeve 228 is provided within each of the housings 216 between the respective ball 224 and the respective casing 140. Accordingly, ball 222 permits swiveling movement of housing 216 with respect to pin 220, and the ball 224, along with housing 216 and attached casing 140, can slide laterally inwardly and outwardly toward and away from plate 182 on pin 220.

Swivel assemblies 188, along with the pivotal mountings of blocks 154, 156 by pins 194, 196 provide for the necessary movement of rollers 130 progressively closer to each other as described above. At the same time, swivel assemblies 188, in conjunction with the aforementioned pivot mountings and the cam surfaces 208 insure that rollers 130 are pulled toward each other and caused to bear firmly against opposite sides 14 of workpiece 10, rather than merely loosely sliding therealong.

The action of rollers 130 and 172 in forming the external peripheral areas of workpiece 10 can best be seen by comparing FIGS. 4, 5, and 6. At this point, it is noted that drive surfaces 132 of rollers 130 include opposed frustoconical sections **132*a* diverging radially inwardly with respect to workpiece 10 and curved (generally paraboloid) sections 132*b*, which adjoin sections 132*a* at their closest points and diverge radially outwardly with respect to workpiece 10. The edges of surface sections 132*b* distal sections 132*a* are in turn continuous with cylindrical surfaces 176 of floating rollers 172 which continue to diverge radially outwardly with respect to workpiece 10**.

As previously mentioned, rollers 24 will have contacted the rear-most extremeties of their respective cam surfaces 208, and thus rollers 130 will have been brought into engagement with workpiece 10 to rotate same, before the first tool 92 engages workpiece 10. As shown in FIG. 4 when workpiece 92 has reached its terminal forming position, the periphery of the workpiece will have been split by working surface **92*a* to form diverging annular lips 129 defining groove 128 therebetween. At this point, rollers 214 will have progressed forwardly along cam surfaces 208 by a sufficient distance such that sections 132*a* of drive surfaces 132 of rollers 130 are beginning to embed themselves into workpiece 10. As rollers 130 thus reduce the thickness of workpiece 10, and as they are drawn radially outwardly along that workpiece, they force the metal displaced by such reduction in thickness radially outwardly thereby increasing the outer diameter of the workpiece, and specifically of lips 129. However, the fact that surface sections 132***a* diverge radially inwardly with respect to workpiece 10, along with proper spacing of cam bodies 206, insures that the transition between the central portion of the workpiece which remains at its original thickness and the peripheral area of reduced thickness will be a smooth, gradual transition. In other words, no abrupt shoulder, groove or the like is formed which could represent a structurally weak area.

FIG. 5 shows the positions of roller 130 and the configuration of workpiece 10 at the time tool 94 has reached its terminal forming position. It can be seen that surface sections 132*a* have been brought even closer together and have further reduced the thickness of the adjacent area of workpiece 10, the metal of the workpiece thus displaced being caused to flow radially outwardly along workpiece 10 by outwardly diverging surface sections 132*b* as indicated at 230. It can also be seen that such flow of material has lengthened lips 129 of the workpiece as compared to their length in the position of FIG. 4 thereby increasing the outer diameter of the workpiece.

FIG. 6 shows the last tool 96 in its terminal forming position with rollers 130 and 172 also being in their terminal position. By this time, floating rollers 172 will have been brought into contact with the workpiece. Surfaces 176 thereof, together with the substantially continuous sections 132*b* of the drive surfaces of rollers 130 generally parallel the configuration of working surface 96*a* of tool 96. Thus surfaces 132*b* and 176 urge the material of the workpiece against working surfaces 96*a, l cooperating with the latter surface to force the interior of groove 128 to conform to its configuration, while simultaneously properly forming the external configuration of lips 129. More specifically, surfaces 176 of rollers 172 prevent the outer edges of lips 129 from curling and cause their outer surfaces to remain generally parallel to the configuration of working surface 96a.* It can also be seen that lips 129 have been further lengthened by the radially outward displacement of material by rollers 130 and 172.

Likewise, it can be seen that surface sections 132*a* have formed a reduced thickness area just inwardly of lips 129 and groove 128, the transition between that area and the central portion of workpiece 10 being a smooth or gradual one. Finally, it is noted that the compressive forces exerted on workpiece 10 by the urging together of surfaces 132, as well as the compressive forces on lips 129 by the urging of surfaces 132*b* and 176 toward working surface 96*a* of the tool 96 work harden the entire peripheral area of workpiece 10 while properly forming same.

It can be appreciated that, for optimum performance of the apparatus and method of the present invention, the rates of movement of tool carrier 100, and screw 180 must be coordinated with each other as well as with the rate of rotation of rollers 130. It can also be appreciated that it may be necessary to vary one or another of these rates during various stages of the process. Accordingly, each of the motors 116, 184 and 162 are preferably variable speed motors either independently operable by a human operator or properly automatically coordinated by suitable electronic circuitry or the like. As previously mentioned, headstock and tailstock assemblies 42 and 44 are adjustable along plates 48 and 78 to accommodate workpieces of different diameters. Likewise, cam bodies 206 may be adjusted laterally inwardly or outwardly by associated screw assemblies 232 extending through side plates 18 of the apparatus to adjust for different thicknesses of workpieces. The slots 207 in cam bodies 206 which receive mounting nut and bolt assemblies 205 are elongated laterally of the apparatus generally to permit such adjustments. To further adjust for different size workpieces and/or grooves, bodies 206 may be removed from screw assemblies 232 and replaced by other bodies having different sized or shape cam surfaces. Rollers 130 and 172 and tools 92, 94, and 96 can likewise be removed and replaced.

After the workpiece 10 has been properly formed into a sheave by the procedure described above, terminating with the apparatus in the position shown in FIG. 6, motor 184 may be reversed to urge screw 180 inwardly toward the axis of the workpiece. As rollers 214 drop into cut-away areas 210 of cam bodies 206, they release their gripping force on workpiece 10. Headstock and tailstock assemblies 42 and 44 can then be retracted and the sheave removed. Either before or after removal of the workpiece, tool carrier 100 is raised to its original uppermost position. The apparatus is then in condition for emplacement of a new workpiece and beginning of the next sequence of operation.

It can be appreciated that numerous modifications of the preferred embodiment described above may be made without departing from the spirit of the invention. For example, while the tool guide means illustrated carries tools 92, 94 and 96 in a straight line path, in other embodiments, the tools could have a curved path as long as the outer extremeties of the tools pass longitudinally to the locus of the bottom of the groove to be formed. Likewise, in the preferred embodiment shown, such locus is the same as to each tool, since the second and third tools laterally widen but do not deepen the groove. However, in embodiments where successive tools deepen the groove, each tool's working surface should pass tangentially to the locus of the respective groove depth it is to form. Other modifications will suggest themselves to those of skill in the art. Accordingly, it is intended that the scope of the present invention be limited only by the claims which follow.

What is claimed is:

1. Apparatus for forming an external annular radial groove in the periphery of a circular workpiece comprising:

support means for supporting said workpiece for rotation about its own axis;

at least one groove-forming tool having a working surface for extending radially into the periphery of said workpiece;

tool guide means adjacent said support means and carrying said tool for movement past said workpiece in a path such that the outer extremity of said working surface passes generally tangentially to the locus of the bottom of a groove to be formed by said tool in said workpiece;

tool drive means associated with said tool guide means for moving said tool in said path;

a pair of drive rollers mounted on said support means for rotation about respective axes disposed angularly with respect to the axis of said workpiece and having respective opposed generally radially outwardly facing drive surfaces disposed for engagement with respective axially opposite sides of said workpiece distal the axis of said workpiece, and means for rotating said rollers about their respective axes to thereby rotate said workpiece about its axis;

radial drive means for moving said drive rollers generally radially outwardly with respect to said workpiece and toward said working surface of said tool;

and a pair of floating rollers each mounted coaxially with and radially outwardly of a respective one of said drive rollers, said floating rollers defining opposed forming surfaces for contacting and forming external areas of said workpiece.

2. The apparatus of claim 1 wherein the path of said tool and the path of the periphery of said workpiece have overlapping sections, and the path of said tool being disposed with respect to the path of the periphery of said workpiece such that said working surface extends progressively deeper into the periphery of said workpiece as said tool moves through at least a first portion of the overlapping sections of said paths.

3. The apparatus of claim 2 wherein said tool and said workpiece move in generally the same direction over said overlapping sections of said paths.

4. The apparatus of claim 3 wherein said tool is a forming disk, the radially outer surface of said disk being said working surface, said disk being mounted on said tool guide means for rotation about its own axis, and the axis of said disk being parallel to the axis of said workpiece.

5. The apparatus of claim 4 wherein the path of said tool is a substantially straight line path.

6. The apparatus of claim 5 wherein said tool guide means comprises a stationary guide frame and a carrier on which said disc is mounted, said carrier being mounted for generally straight line movement on said guide frame, and said tool drive means being operative to move said carrier on said guide frame.

7. The apparatus of claim 6 wherein said carrier is elongated in its direction of movement and carries a plurality of such disks spaced along its length for sequential passage through the overlapping sections of said paths, said disks having respective successively wider working surfaces for progressively laterally enlarging the groove in said workpiece.

8. The apparatus of claim 7 wherein said disks are mounted for idling rotation via contact with said workpiece.

9. The apparatus of claim 4 wherein said tool has a terminal forming position on said overlapping sections of said paths wherein a radius of said workpiece is continuous with and colinear with a radius of said tool, said rollers being disposed on opposite sides of the locus of said colinear radii, and said radial drive means moving said rollers generally lengthwise with respect to said locus of said colinear radii to move said drive surfaces toward the working surface of said tool in said terminal forming position whereby said drive surfaces serve as additional forming surfaces for forming external areas of said workpiece adjacent said groove.

10. The apparatus of claim 9 comprising means operatively associated with said rollers for urging said drive surfaces progressively closer to each other against said workpiece as said rollers are so moved toward said working surface of said tool.

11. The apparatus of claim 10 wherein said means for urging said drive surfaces closer comprises cam means cooperative between said support means and said rollers and inclined with respect to said workpiece.

12. The apparatus of claim 11 wherein said workpiece is adjustable with respect to said tool guide means, said cam means is adjustable with respect to said support means, and said tool and said rollers are removable and replaceable for accommodating different size workpieces.

13. The apparatus of claim 11 wherein the axes of said rollers are inclined with respect to said workpiece.

14. The apparatus of claim 10 wherein said drive surfaces are sized and configured, cooperatively with said means for urging them closer, to reduce the axial thickness and increase the outer diameter of said workpiece adjacent its periphery by deforming the material of said workpiece as said drive surfaces are so moved toward said working surface of said tool.

15. The apparatus of claim 14 wherein said working surface diverges radially outwardly with respect to said workpiece, and said drive surfaces of said rollers include opposed sections diverging radially outwardly with respect to said workpiece and cooperative said working surface to form diverging annular lips on the periphery of said workpiece, said lips defining said groove therebetween.

16. The apparatus of claim 15 wherein said drive surfaces further include opposed sections disposed radially inwardly of said diverging sections with respect to said workpiece and diverging radially inwardly with respect to said workpiece to form a section of reduced thickness in said workpece radially inwardly of said lips.

17. The apparatus of claim 16 wherein each of said floating rollers is disposed radially outwardly of the outwardly diverging section of the respective drive surface with respect to said workpiece, said forming surfaces of said floating rollers diverging radially outwardly with respect to said workpiece and substantially continuous with the outwardly diverging sections of said drive surfaces for further cooperating with said working surface in forming said lips.

18. The apparatus of claim 16 wherein said tool guide means carries a plurality of such tools for sequential passage through the overlapping sections of said paths and having respective successively wider working surfaces for progressively laterally enlarging the groove in said workpiece, said driving surfaces being cooperative with the last one of said tools to form said lips.

19. The apparatus of claim 1 wherein said workpiece is a metal disk to be formed into a sheave.

20. Apparatus for forming an external annular radial groove in the periphery of a circular workpiece comprising:

support means for supporting said workpiece for rotation about its own axis;

at least one groove-forming tool having a working surface for extending radially into the periphery of said workpiece;

tool drive means operatively associated with said tool for moving said tool progressively radially deeper into the periphery of said workpiece to form said groove;

a pair of drive rollers mounted on said support means for rotation about respective axes disposed angularly with respect to the axis of said workpiece and having respective opposed generally radially outwardly facing drive surfaces disposed for engagement with respective axially opposite sides of said workpiece distal the axis of said workpiece;

means for rotating said rollers about their respective axes to thereby rotate said workpiece about its axis;

radial drive means for moving said rollers generally radially outwardly with respect to said workpiece and toward said working surface of said tool whereby said drive surfaces serve as forming surfaces for forming external areas of said workpiece adjacent said groove; and cam means cooperative between said support means and said rollers and inclined with respect to said workpiece for urging said drive surfaces progressively closer to each other against said workpiece as said rollers are so moved toward said working surface of said tool.

21. The apparatus of claim 20 wherein said drive surfaces are sized and configured cooperatively with said means for urging them closer to reduce the axial thickness and increase the outer diameter of said workpiece adjacent its periphery by deforming the material of said workpiece as said drive surfaces are so moved toward said working surface of said tool.

22. Apparaus for forming an external annular radial groove in the periphery of a circular workpiece comprising:

support means for supporting said workpiece for rotation about its own axis;

at least one groove-forming tool having a working surface for extending radially into the periphery of said workpiece and divering radially outwardly with respect to said workpiece;

a pair of forming means disposed generally on respective axially opposite sides of said workpieces and comprising a pair of drive rollers mounted on said support means for rotation about respective axes disposed angularly with respect to the axis of said workpiece and having respective opposed generally radially outwardly facing drive surfaces disposed for engagement with respective axially opposite sides of said workpiece distal the axis of said workpiece;

means for rotating said rollers about their respective axes to thereby rotate said workpiece about its axis;

and radial drive means for moving said rollers generally radially outwardly with respect to said workpiece and toward said working surface of said tool whereby said drive surfaces serve as forming surfaces for forming external areas of said workpiece adjacent said groove;

said forming means including opposed forming surfaces diverging radially outwardly with respect to said workpiece and cooperative with said working surface to form diverging annular lips on the periphery of said workpiece defining said groove therebetween.

23. The apparatus of claim 22 wherein said drive surfaces include outwardly diverging sections partially defining said forming surfaces and further include outer opposed sections disposed radially inwardly of said outwardly diverging sections with respect to said workpiece and diverging radially inwardly with respect to said workpiece to form a section of reduced thickness in said workpiece radially inwardly of said lips.

24. The apparatus of claim 23 wherein each of said rollers is mounted on a respective rotary shaft, said forming means further comprising a respective floating roller on each of said shafts disposed radially outwardly of the outwardly diverging sections of said drive surfaces with respect to said workpiece, said floating rollers including opposed sections further defining said forming surfaces diverging radially outwardly with respect to said workpiece and substantially continuous with the outwardly diverging sections of said drive surfaces.

25. A method of forming a sheave having an external annular radial groove from a generally flat-sided disk-shaped workpiece comprising the steps of:

rotating said workpiece about its own axis;

urging a working surface of a groove-forming tool progressively radially deeper into the periphery of said workpiece during such rotation;

disposing a pair of forming members having opposed forming surfaces on axially opposite sides of said workpiece;

moving said forming members radially outwardly along said workpiece toward said working surface of said tool while urging said forming surfaces toward each other against said workpiece.

26. The method of claim 25 wherein said forming members are urged progressively closer to each other as they are moved radially outwardly along said workpiece.

27. The method of claim 26 wherein said forming members comprise a pair of rollers having respective axes disposed angularly with respect to the axis of said workpiece, and wherein said rotation of said workpiece is performed by rotating said rollers about their axes while so urging them toward each other against said workpiece.

28. The method of claim 25 wherein the urging of said working surface into the periphery of said workpiece is accomplished by moving said tool past said workpiece in a path such that the outer extremity of said working surface passes generally tangentially to the locus of the bottom of the groove to be formed in said workpiece.

29. The method of claim 28 wherein said tool is moved in a generally straight line path past said workpiece.

30. The method of claim 29 comprising so moving a plurality of such tools successively past said workpiece, said tools having successively laterally wider working surfaces for laterally enlarging said groove.

31. The method of claim 30 wherein said external forming members are moved to a radially outermost position with respect to said workpiece while the last one of said tools is in its radially innermost position with respect to said workpiece.

32. The method of claim 25 including moving said forming members into a radially outer position adjacent the outer extremity of said workpiece, whereby said forming surfaces and said working surface cooperatively form annular lips on the periphery of said workpiece defining said groove therebetween, said forming surfaces forming the laterally outer sides of said lips, and said working surface forming the laterally inner surfaces of said lips.

33. A method of forming an external annular radial groove in the periphery of a circular workpiece comprising the steps of:

rotating said workpiece about its own axis;

moving a groove-forming tool having a working surface for extending radially into the periphery of said workpiece past said workpiece during such rotation in a path such that the outer extremity of said working surface passes generally tangentially to the locus of the groove to be formed by said tool in said workpiece;

and urging a pair of forming members toward respective axially opposite sides of said workpiece while moving said forming members radially outwardly along said workpiece to a position adjacent the outer extremity of said workpiece, whereby said forming surfaces and said working surface cooperatively form annular lips on the periphery of said workpiece defining said groove therebetween, said forming surfaces forming the laterally outer sides of said lips, and said working surface forming the laterally inner surfaces of said lips.

34. The method of claim 33 comprising so moving a plurality of such tools successively past said workpiece, said tools having successively laterally wider working surfaces for laterally enlarging said groove.

* * * * *